US006054041A

United States Patent [19]

Ellis et al.

[11] Patent Number: 6,054,041

[45] Date of Patent: Apr. 25, 2000

[54] THREE STAGE COCURRENT LIQUID AND VAPOR HYDROPROCESSING

[75] Inventors: Edward S. Ellis, Basking Ridge, N.J.; William Ernest Lewis, Baton Rouge, La.; David C. Dankworth, Whitehouse Station; Ramesh Gupta, Berkeley Heights, both of N.J.

[73] Assignee: Exxon Research and Engineering Co., Florham Park, N.J.

[21] Appl. No.: 09/073,412

[22] Filed: May 6, 1998

[51] Int. Cl.[7] ..... C10G 45/00

[52] U.S. Cl. ..... 208/210; 208/211

[58] Field of Search ..... 208/210, 211

[56] References Cited

U.S. PATENT DOCUMENTS

| | | | |
|---|---|---|---|
| 2,952,626 | 9/1960 | Kelley et al. | 208/210 |
| 4,021,330 | 5/1977 | Satchell, Jr. | 208/210 |
| 4,138,327 | 2/1979 | Scott | 208/146 |
| 4,140,625 | 2/1979 | Jensen | 208/96 |
| 4,243,519 | 1/1981 | Schorfheide | 208/210 |
| 4,430,203 | 2/1984 | Cash | 208/210 |
| 4,801,373 | 1/1989 | Corman et al. | 208/210 |
| 5,292,428 | 3/1994 | Harrison et al. | 208/208 R |
| 5,670,116 | 9/1997 | Gupta et al. | 422/191 |
| 5,705,052 | 1/1998 | Gupta | 208/57 |
| 5,720,872 | 2/1998 | Gupta | 208/57 |

*Primary Examiner*—Helane Myers
*Attorney, Agent, or Firm*—Henry E. Naylor

[57] ABSTRACT

A hydroprocessing process includes two cocurrent flow liquid reaction stages and one vapor stage, in which feed components are catalytically hydroprocessed by reacting with hydrogen. The liquid stages both produce a liquid and a hydrogen-rich vapor effluent, with most of the hydroprocessing accomplished in the first stage. The first stage vapor is also hydroprocessed. The hydroprocessed vapor and second stage vapor are cooled to condense and recover additional product liquid and produce an uncondensed hydrogen-rich vapor. After cleanup to remove contaminants, the hydrogen-rich vapor is recycled back into the first stage as treat gas. Fresh hydrogen is introduced into the second stage. This is useful for hydrotreating heteroatom-containing hydrocarbons.

18 Claims, 2 Drawing Sheets

THREE STAGE COCURRENT LIQUID AND VAPOR HYDROPROCESSING

BACKGROUND OF THE DISCLOSURE

1. Field of the Invention

The invention relates to hydroprocessing a hydrocarbonaceous feed in cocurrent flow liquid stages and a vapor stage. More particularly the invention relates to catalytically hydroprocessing a hydrocarbonaceous feed in first and second liquid reaction stages in which the feed and hydrogen flow cocurrently and in a vapor phase reaction stage. The feed enters the first stage, with the first stage liquid effluent the liquid feed to the second stage and the second stage liquid effluent the product liquid. The first stage vapor effluent is hydroprocessed in the vapor stage and then cooled to condense and recover heavier vapor components as additional product liquid. Fresh hydrogen enters the second stage, with a portion passed to the first and vapor stages. The second and vapor stages may be in the same vessel.

2. Background of the Invention

As supplies of lighter and cleaner feeds dwindle, the petroleum industry will need to rely more heavily on relatively high boiling feeds derived from such materials as coal, tar sands, shale oil, and heavy crudes, all of which typically contain significantly more undesirable components, especially from an environmental point of view. These components include halides, metals, unsaturates and heteroatoms such as sulfur, nitrogen, and oxygen. Furthermore, due to environmental concerns, specifications for fuels, lubricants, and chemical products, with respect to such undesirable components, are continually becoming tighter. Consequently, such feeds and product streams require more upgrading in order to reduce the content of such undesirable components and this increases the cost of the finished products.

In a hydroprocessing process, at least a portion of the heteroatom compounds are removed, the molecular structure of the feed is changed, or both occur by reacting the feed with hydrogen in the presence of a suitable hydroprocessing catalyst. Hydroprocessing includes hydrogenation, hydrocracking, hydrotreating, hydroisomerization and hydrodewaxing, and therefore plays an important role in upgrading petroleum streams to meet more stringent quality requirements. For example, there is an increasing demand for improved heteroatom removal, aromatic saturation and boiling point reduction. In order to achieve these goals more economically, various process configurations have been developed, including the use of multiple hydroprocessing stages as is disclosed, for example, in European patent publication 0 553 920 A1 and U.S. Pat. Nos. 2,952,626; 4,021,330; 4,243,519; 4,801,373 and 5,292,428.

SUMMARY OF THE INVENTION

The invention relates to a process for hydroprocessing a hydrocarbonaceous feed in which the feed and hydrogen flow cocurrently through two liquid reaction stages, in which the feed reacts with the hydrogen in the presence of a hydroprocessing catalyst to produce a vapor and a liquid effluent which are separated after each stage, with both vapor effluents containing hydrocarbonaceous vapors. The feed is introduced into the first stage; the first stage liquid effluent is the feed to the second stage, and the second stage liquid effluent is the hydroprocessed product liquid. The first stage vapor effluent is hydroprocessed in a vapor phase reaction stage. The vapor stage and second stage vapor effluents comprise hydroprocessed hydrocarbonaceous material, at least a portion of which (e.g., $C_{4+}$–$C_{5+}$ material) may be recovered as additional product liquid, by cooling the effluents to condense the liquid and also produce a hydrogen rich vapor. The hydrogen rich vapor is separated from the condensed liquid, cleaned up to remove contaminants and recycled back into the first stage. Fresh hydrogen or a hydrogen-containing treat gas provides the second liquid stage reaction hydrogen and the first stage vapor effluent contains sufficient unreacted hydrogen to hydroprocess the hydrocarbonaceous vapor in it. The uncondensed, hydrogen-rich vapor provides all or a portion of the hydrogen for the first liquid stage and the vapor stage after being processed to remove contaminants. The second and vapor stages may be located in a single reaction vessel. The term "hydrogen" as used herein refers to hydrogen gas. More particularly the invention comprises a hydroprocessing process which includes a vapor reaction stage and two liquid reaction stages which comprises the steps of:

(a) reacting a feed comprising a hydrocarbonaceous liquid with hydrogen in a first cocurrent flow reaction stage in the presence of a hydroprocessing catalyst to form a first stage effluent comprising a mixture of a partially hydroprocessed hydrocarbonaceous liquid and a hydrogen-containing hydrocarbonaceous vapor;

(b) separating said liquid and vapor effluent;

(c) reacting said first stage liquid effluent with fresh hydrogen in the presence of a hydroprocessing catalyst in a second cocurrent flow hydroprocessing reaction stage to produce a mixture of hydroprocessed hydrocarbonaceous vapor and product liquid effluents;

(d) separating said liquid and vapor effluents;

(e) reacting said first stage vapor effluent with hydrogen in the presence of a hydroprocessing catalyst in a vapor hydroprocessing reaction stage to produce an effluent comprising hydroprocessed hydrocarbonaceous vapor, wherein said vapor stage reaction hydrogen is provided by unreacted hydrogen in said first stage vapor effluent;

(f) cooling said second stage and said vapor stage vapor effluents to condense a portion of said hydroprocessed hydrocarbonaceous vapor as additional product liquid and produce a hydrogen-rich vapor;

(g) separating said liquid from said hydrogen-rich vapor, and (h) passing said uncondensed hydrogen-rich vapor to said first stage to provide said first stage and said vapor stage reaction hydrogen.

If contaminants are present in the hydrogen-rich vapor formed in step (f), they are removed before it is recycled back into the first stage. This process eliminates the need for interstage liquid recycle and permits the use of simple flash and drum separation of the liquid and vapor phases, thereby eliminating the need for more complex and costly fractionation towers. Separation of the liquid and vapor effluent is accomplished by simple flash separation zones which can include a flash space in one of the reaction vessels for the first stage effluent and simple drum separators for the vapor and second stages, and also following cooling and condensation of the higher molecular weight vapors. The uncondensed vapor will typically comprise the lighter (e.g., ~$C_{4-}$ depending on the temperature and pressure) hydrocarbonaceous material, unreacted hydrogen, gaseous contaminants, if present, and hydrogen treat gas diluent, if present. Further, operating the first liquid stage at a sufficiently higher pressure than the second stage eliminates the need for a pump to pass the first stage effluent to the second stage.

In a preferred embodiment, fresh hydrogen or a hydrogen-containing treat gas is passed only into the second liquid stage, and in an amount sufficient to provide all of the reaction hydrogen required for the first and vapor stages, via recycle of the hydrogen-rich vapor recovered by steps (f) and (g) above back into the fist liquid stage. In an embodiment in which the hydrogen-rich vapor contains contaminants which have been removed from the feed, these contaminants are removed prior to the recycle. An example is hydrotreating a hydrocarbon fraction to remove sulfur and nitrogen. In this embodiment, most of the sulfur and nitrogen compounds in the feed liquid are converted to $H_2S$ and $NH_3$ in the first liquid stage and pass into the vapor, along with vaporized hydrocarbons, unreacted hydrogen and normally gaseous hydrocarbons, such as methane. Because of the simple flash separation of the first stage liquid and vapor effluents, the first stage vapor effluent contains some sulfur and nitrogen containing hydrocarbon material which is hydroprocessed in the vapor stage. The vapor stage hydroprocessing provides a means for removing some of the heteroatom or other contaminant containing hydrocarbonaceous compounds from the first stage liquid effluent and condensing relatively heteroatom-free vapors to liquid which may be blended with the second stage liquid effluent as additional product liquid. The catalyst used in each stage may be the same or different, depending on the feed and the process objectives. In some cases fresh hydrogen or a hydrogen-containing treat gas may also be passed into either or both the first and vapor stages.

In the practice of the invention, the fresh hydrocarbonaceous feed fed into the first stage reaction zone is mostly liquid and typically completely liquid. During the hydroprocessing, at least a portion of the lighter or lower boiling feed components are vaporized in each liquid stage. The amount of feed vaporization will depend on the nature of the feed and the temperature and pressure in the reaction stages and may range between about 5–80 wt. %. In an embodiment in which the process is a hydrotreating process for a sulfur and nitrogen containing distillate or diesel fuel fraction, the hydroprocessing forms $H_2S$ and $NH_3$, some of which is dissolved in the hydroprocessed product liquid and vapor condensate. Simple stripping removes these species from these liquids.

DETAILED DESCRIPTION

Figure 1:
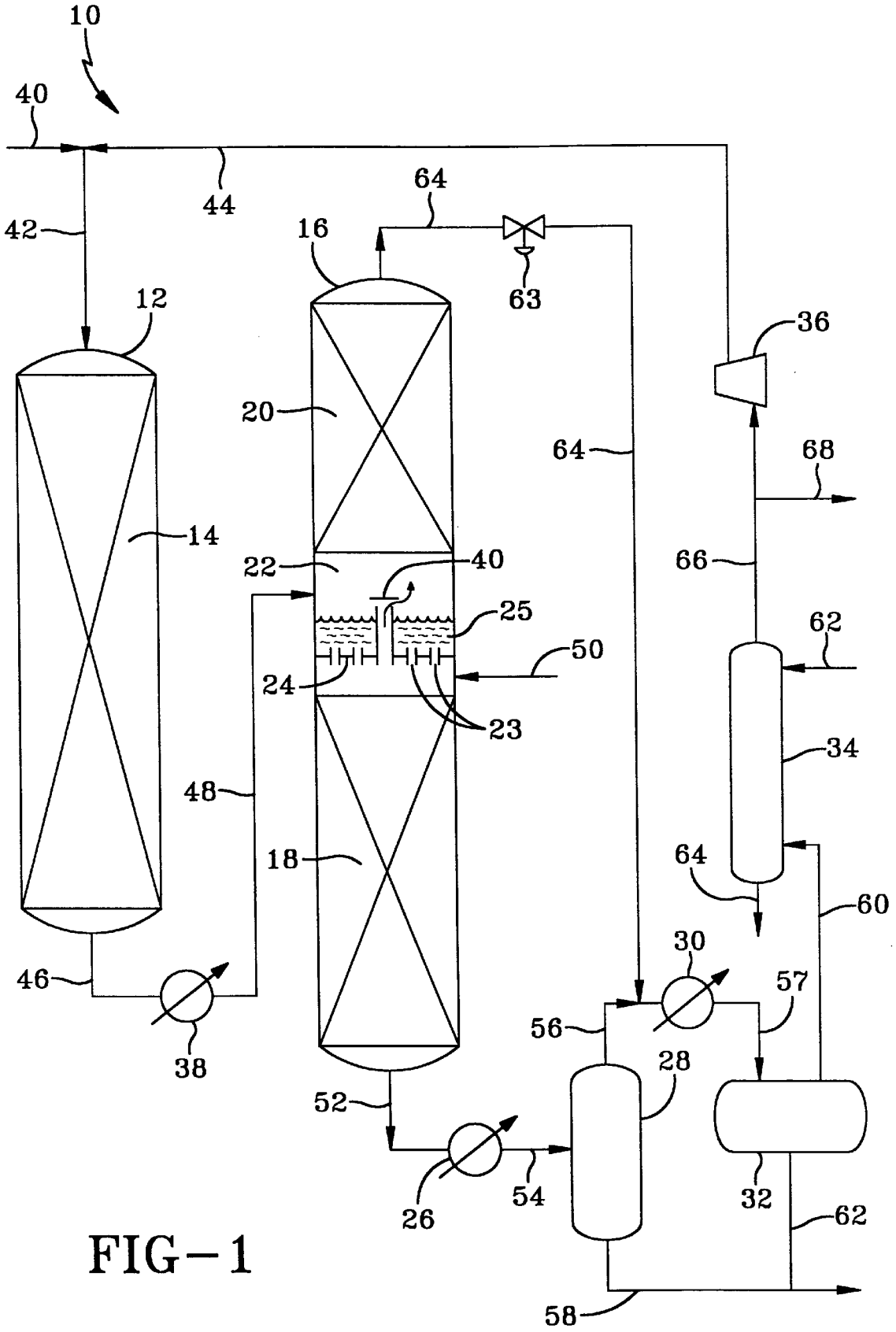
FIG. 1 is a simple schematic flow diagram of a hydrotreating process according to the practice of the invention in which the second and vapor stages are in the same vessel.

By hydroprocessing is meant a process in which hydrogen reacts with a hydrocarbonaceous feed to remove one or more heteroatom impurities such as sulfur, nitrogen, and oxygen, to change or convert the molecular structure of at least a portion of the feed, or both. Non-limiting examples of hydroprocessing processes which can be practiced by the present invention include forming lower boiling fractions from light and heavy feeds by hydrocracking; hydrogenating aromatics and other unsaturates; hydroisomerization and/or catalytic dewaxing of waxes and waxy feeds, and demetallation of heavy streams. Ring-opening, particularly of naphthenic rings, can also be considered a hydroprocessing process. By hydrocarbonaceous feed is meant a primarily hydrocarbon material obtained or derived from crude petroleum oil, from tar sands, from coal liquefaction, shale oil and hydrocarbon synthesis. The reaction stages used in the practice of the present invention are operated at suitable temperatures and pressures for the desired reaction. For example, typical hydroprocessing temperatures will range from about 40° C. to about 450° C. at pressures from about 50 psig to about 3,000 psig, preferably 50 to 2,500 psig.

Feeds suitable for use in such systems include those ranging from the naphtha boiling range to heavy feeds, such as gas oils and resids. Non-limiting examples of such feeds which can be used in the practice of the present invention include vacuum resid, atmospheric resid, vacuum gas oil (VGO), atmospheric gas oil (AGO), heavy atmospheric gas oil (HAGO), steam cracked gas oil (SCGO), deasphalted oil (DAO), light cat cycle oil (LCCO), natural and synthetic feeds derived from tar sands, shale oil, coal liquefaction and hydrocarbons synthesized from a mixture of $H_2$ and CO via a Fischer-Tropsch type of hydrocarbon synthesis.

For purposes of hydroprocessing and in the context of the invention, the terms "fresh hydrogen" and "hydrogen-containing treat gas" are synonymous and may be either pure hydrogen or a hydrogen-containing treat gas which is a treat gas stream containing hydrogen in an amount at least sufficient for the intended reaction plus other gas or gasses (e.g., nitrogen and light hydrocarbons such as methane) which will not adversely interfere with or affect either the reactions or the products. These terms exclude recycled vapor effluent from another stage which has not been processed to remove contaminants and at least a portion of any hydrocarbonaceous vapors present. They are meant to include either hydrogen or a hydrogen-containing gas from any convenient source, including the hydrogen-containing gas comprising unreacted hydrogen recovered from hydroprocessed vapor effluent, after first removing at least a portion and preferably most of the hydrocarbons (e.g., $C_{4+}$–$C_{5+}$) or hydrocarbonaceous material and any contaminants (e.g., $H_2S$ and $NH_3$) from the vapor, to produce a clean, hydrogen rich treat gas. The treat gas stream introduced into a reaction stage will preferably contain at least about 50 vol. %, more preferably at least about 75 vol. % hydrogen. In operations in which unreacted hydrogen in the vapor effluent of any particular stage is used for hydroprocessing in a subsequent stage or stages, there must be sufficient hydrogen present in the fresh treat gas introduced into that stage for the vapor effluent of that stage to contain sufficient hydrogen for the subsequent stage or stages.

In the embodiment shown in FIG. 1, the hydroprocessing process is a hydrotreating process and the reaction stages hydrotreating stages. Referring to FIG. 1, a hydrotreating unit 10 comprises a first cocurrent liquid reaction stage comprising a catalyst bed 14 in downflow reaction vessel 12. Reaction vessel 16 contains a second cocurrent liquid reaction stage comprising catalyst bed 18, above which is a cocurrent vapor reaction stage comprising catalyst bed 20. Flash space or zone 22 permits the mixed vapor and liquid effluent from 12 to separate and an otherwise liquid and gas impervious horizontal tray 24, containing a plurality of hollow chimneys or conduits 23 vertically extending therethrough (only two are labeled for convenience), permits the separated liquid to flow through and be distributed over the catalyst bed 18 below, as well as prevent the first stage vapor from entering the second stage below. Other means for ensuring this are discussed below with reference to FIGS. 2 (*a*) and 2 (*b*). Hot and cold heat exchangers 26 and 30 cool down the respective effluents from the second and vapor stages and into respective hot and cold drum-type vapor-liquid separators 28 and 32 for cooling and condensing the heavier hydrotreated vapors. An amine scrubber 34 and vapor compressor 36 complete the unit. In this particular design, vessel 16 and attendant peripheral equipment can be added onto a single stage hydrotreating (or hydroprocessing) unit to convert it to a two liquid stage unit. Heat exchanger 38 and a hollow gas conduit or chimney 40, including a baffle over it as shown, are optional. Exchanger 38 is used if it is desired to cool the first stage effluent and operate the inlet temperature of the second stage lower than the outlet temperature of the fist stage. The optional capped conduit or chimney 40 may be used to bleed a small amount of fresh hydrogen or hydrogen-containing treat gas passed into the second stage via line 50 up into the vapor space above the tray, to prevent contaminant gas, e.g., $H_2S$ or $NH_3$ from the first stage reactor 12 from entering the second stage reaction zone 18, while allowing the liquid distribution rate of the first stage liquid effluent down into the second stage reaction zone to remain relatively constant. Not shown are one or more simple strippers for stripping any dissolved $H_2S$ and $NH_3$ from the product liquid and condensed vapor. Also not shown are some of the gas and liquid flow distribution means above each catalyst bed for distributing liquid onto and horizontally across the catalyst bed below. Such means are well known to those skilled in the art and may include, for example, trays such as sieve trays, bubble cap trays, trays with spray nozzles, chimneys or tubes, and perforated tube vapor distributors, etc., as is known. The hydrocarbon feed to be hydrotreated is passed via lines 40 and 42 into vessel 12 and down onto, across and through the catalyst bed 14 below. In this particular illustration of the invention, the feed is a petroleum derived distillate or diesel fuel fraction containing heteroatom compounds of sulfur, nitrogen and perhaps oxygen. Fresh hydrogen-containing treat gas is passed into the top of vessel 12 via lines 44 and 42. In the embodiment shown, this fresh treat gas comprises the hydrogen-rich, uncondensed light vapor resulting from the final vapor-liquid separation after the upstream hot and cold staged cooling, from which heteroatom compounds (e.g., $H_2S$, $NH_3$) have been removed by amine scrubbing. This hydrogen-rich gas passes cocurrently down through the catalyst bed with the feed which reacts with the hydrogen in the presence of the hydrotreating catalyst to remove most of the heteroatom impurities from the liquid as gases including, for example, $H_2S$, $NH_3$ and water vapor, as well as forming lighter hydrocarbons such as methane. At the same time some of the heteroatom-containing feed liquid is vaporized. Most of the sulfur and other heteroatom compounds are removed from the feed in this stage. By most is meant over 50% which could be 60%, 75% and even 80%. Therefore, the second cocurrent liquid stage catalyst can be a more active, but less sulfur tolerant catalyst of high activity for aromatics saturation which, for the sake of illustration in this embodiment, comprises nickel-molybdenum or nickel-tungsten catalytic metal components on an alumina support. The pressure in the first stage in this embodiment is high enough so that a compressor is not required to pass the partially hydroprocessed liquid and vapor effluent mixture exiting the bottom of vessel 12 into vessel 16. This mixture of partially hydroprocessed liquid and vapor effluent is passed via line 46, and optionally through a heat exchanger 38 to cool it, and line 48 into flash zone 22 in vessel 16 in which the vapor separates from the liquid. The tray is designed to maintain a predetermined level of the separated liquid 25 on the top to insure a liquid seal between the upper portion of the vessel and the second liquid stage below. This may be aided by level control means, such as those shown in FIGS. 2 (*a*) and 2 (*b*) and explained in detail below, and a pressure control valve 63. The mostly hydroprocessed first stage liquid is passed down through tray 24 onto, across and down through the catalyst bed 18 below. Fresh hydrogen or a fresh treat gas containing hydrogen is introduced into the top of the second stage via line 50. The downflowing liquid mixes with the downflowing hydrogen and reacts with it in the presence of the catalyst to produce a second stage effluent comprising a mixture of a hydrotreated product liquid and hydrotreated vapor, which is withdrawn from the bottom of the vessel via line 52. As is the case for the fist stage, some of the downflowing liquid is vaporized in the second stage also. However, since most of the heteroatom compounds are removed in the first liquid stage and most of those remaining are removed in the second liquid stage, very few unconverted heteroatom compounds are present in the second stage vapor effluent.

The mixture of hydroprocessed product liquid and vapor is passed via line 52 through heat exchanger 26 which cools the mixture down to a temperature in the range of from about 250–600° F. This condenses the heavier hydrocarbons (e.g., $C_{10+}$) to liquid and the mixture is then passed into a simple drum separator 28 via line 54, in which the remaining vapor flashes off and is removed overhead via line 56. The separated product liquid, which now comprises both the second stage liquid effluent and the hydrocarbons condensed from the second stage vapor, is removed from the separator via line 58. The separated vapors are then passed via line 56, in which they are mixed with the hydroprocessed vapor effluent from the vapor stage, through heat exchanger 30 in which they are cooled down to a temperature in the range of about 100–120° F. which condenses all but the $C_{4-}$–$C_{5-}$ (depending on the pressure) hydrocarbon material as liquid, with the liquid and remaining vapor components (which includes the $H_2S$ and $NH_3$) then passed via line 57 into a second or cold drum separator 32. The vapor is removed overhead via line 60 and further processed as is explained in detail below. The separated liquid condensate is removed via line 62 and passed into line 58 as additional product liquid. While not shown, small amounts of $H_2S$ and $NH_3$ which may by dissolved in the product liquid may be removed by simple stripping.

Returning to the upper portion of vessel 16, the separated vapor effluent from the first stage hydroprocessing in vessel 12 is passed up through vapor stage reaction zone 20 in which it reacts with unreacted hydrogen in the vapor to hydrotreat the heteroatom-containing hydrocarbon vapors to produced a vapor effluent comprising the hydrotreated vapor components of the feed, along with $H_2S$, $NH_3$ and light gasses (e.g., $C_4$–$C_{5-}$) formed by the reaction. This hydroprocessed vapor is passed via line 64 to line 56 where it meets and mixes with the vapor coming from the hot separator 28, with the combined vapor stream cooled in heat exchanger 30, etc. as outlined above. The vapor stream in line 60 contains the uncondensed light hydrocarbons, hydrogen preferably in an amount sufficient for the first liquid and the vapor stage reactions, $H_2S$ and $NH_3$. This stream in passed via line 60 into the bottom of an amine scrubber 34 into the top of which an aqueous amine solution is passed via line 62. The amine solution removes the $H_2S$ and $NH_3$ from the vapor to produce a clean vapor, with the heteroatom laden solution then removed from the bottom of the scrubber via line 64 and sent to processing for recovery of the amine, as is well known. The hydrogen-containing, clean vapor is passed via line 66 into compressor 36 which passes the clean vapor into the first stage in vessel 12 via lines 44 and 42 as treat gas. A purge line 68 bleeds off some of the vapor to prevent build-up of the light hydrocarbons in the system.

Figure 2A:
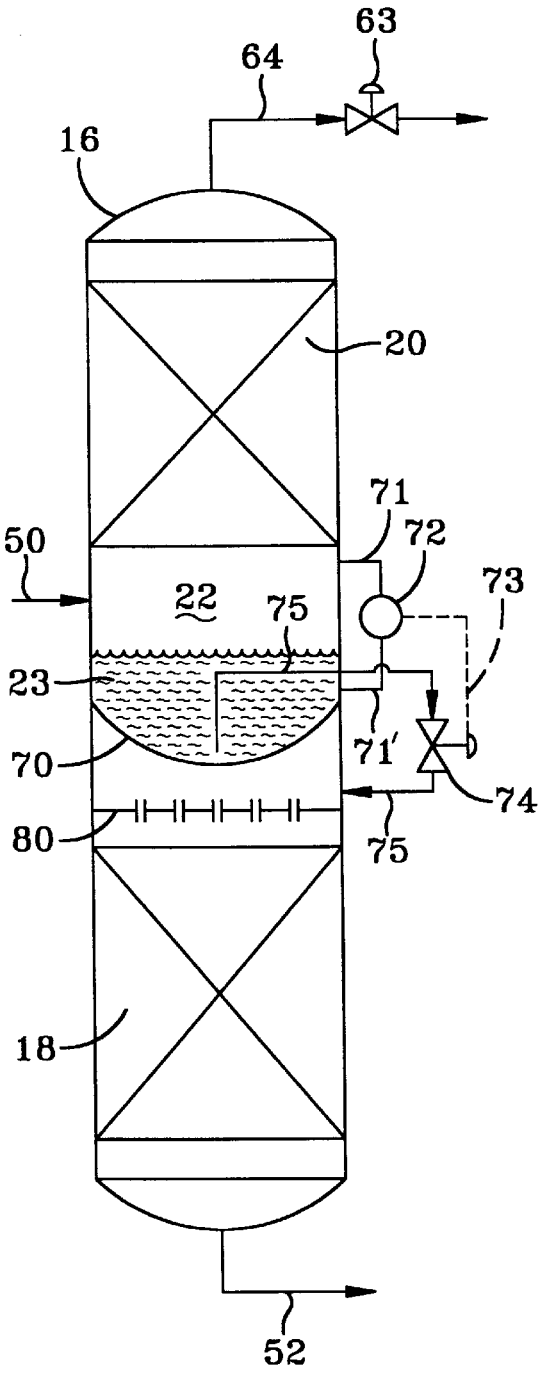
FIGS. 2(*a*) and 2(*b*) schematically illustrate two different means for controlling the liquid level on the inter-stage tray separation means between the vapor and second liquid stages.
Figure 2B:
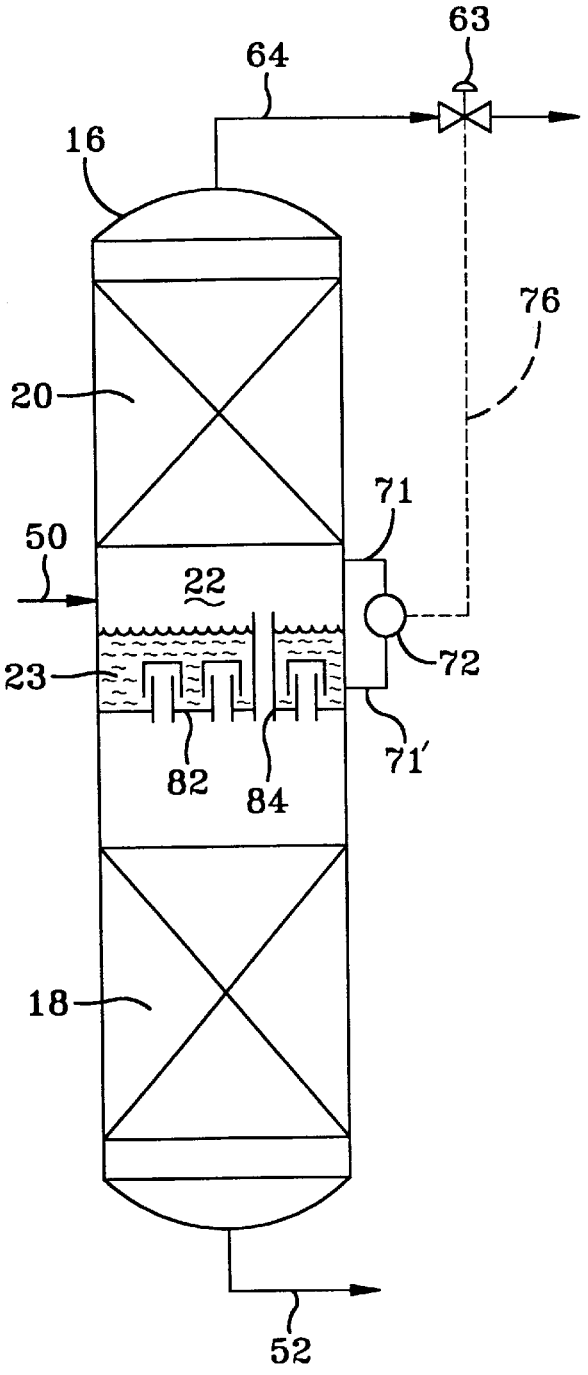

FIGS. 2 (*a*) and 2 (*b*) schematically illustrate two different means for controlling the liquid level on the means which separates the vapor reaction stage from the second liquid reaction stage below in vessel 16. In FIG. 2 (*a*), a solid, hemispherical or other arcuate shaped, gas and liquid impervious plate 70 is shown located between both stages and sealing them off from each other. The liquid 23 level over the plate is maintained by a combination of a pressure sensing means 72 which senses the pressure differential between the space above the liquid 23 on top of plate 70 and in the liquid itself, at a predetermined location which is determined by the desired liquid level maintenance. The pressure sensing means 72 includes means (not shown) for measuring the pressure above the liquid and at the desired level in the liquid, and is connected to these means by electrical connectors 71 and 71', as shown. The pressure sensing means produces an electrical signal, either analog or digital, whose value is determined by the pressure and transmits the signal by suitable means such as an electrical cable illustrated in phantom as 73, to a level control valve 74. The level control valve is located in liquid transfer line 75, one end of which is immersed in the liquid above the tray or plate 70 and shuts off the flow of liquid below to the second liquid stage if the level falls below the intake, which makes the pressure differential extremely small. In another embodiment which is not shown, the pressure differential is measured between the flash space 22 and the space under plate 70 above the second stage catalyst bed. An optional liquid distribution means such as a tray 80 is shown for more evenly distributing the liquid on top of the plate 70 to and across the second stage catalyst bed 18 below. In the embodiment shown in FIG. 2 (*b*), a bubble cap tray is shown with a pressure sensing means 72 sensing the pressure differential between a predetermined location within the liquid 23 and the flash space 22 above. An overflow conduit 84 prevents the liquid level on the tray from rising too high. If the liquid level falls below that level, the pressure differential becomes essentially zero and an electrical signal is passed via electrical cable 76 to pressure control valve 63, which opens further to reduce the pressure in the upper portion of the vessel 16, so that the heteroatom contaminated first stage vapor effluent doesn't pass down into the second liquid stage below. Other means may also be used as are known and appreciated by those skilled in the art. Instead of measuring pressure, the actual liquid level on plate 70 or tray 82 may be measured by any known and suitable level measuring means. Other means and combinations of various means may be employed to insure that the first stage liquid effluent and not the vapor is passed to the second stage in the vessel and this is at the discretion of the practitioner.

Those skilled in the art will appreciate that the invention can be extended to more than two liquid and one vapor stages. Thus, one may also employ three or more liquid stages in which the partially processed liquid effluent from the first stage is the second stage feed, the second stage liquid effluent is the third stage feed, and so on, with attendant vapor stage processing in one or more vapor reaction stages. By reaction stage is meant at least one catalytic reaction zone in which the liquid, vapor or mixture thereof reacts with hydrogen in the presence of a suitable hydroprocessing catalyst to produce an at least partially hydroprocessed effluent. The catalyst in a reaction zone can be in the form of a fixed bed, a fluidized bed or dispersed in a slurry liquid. More than one catalyst can also be employed in a particular zone as a mixture or in the form of layers (for a fixed bed). Further, where fixed beds are employed, more than one bed of the same or different catalyst may be used, so that there will be more than one reaction zone. The beds may be spaced apart with optional gas and liquid distribution means upstream of each bed, or one bed of two or more separate catalysts may be used in which each catalyst is in the form of a layer, with little or no spacing between the layers. The hydrogen and liquid will pass successively from zone to the next. The hydrocarbonaceous material and hydrogen or treat gas are introduced at the same or opposite ends of the stage and the liquid and/or vapor effluent removed from a respective end.

The term "hydrotreating" as used herein refers to processes wherein a hydrogen-containing treat gas is used in the presence of a suitable catalyst which is primarily active for the removal of heteroatoms, such as sulfur, and nitrogen, non-aromatics saturation and, optionally, saturation of aromatics. Suitable hydrotreating catalysts for use in a hydrotreating embodiment of the invention include any conventional hydrotreating catalyst. Examples include catalysts comprising of at least one Group VIII metal catalytic component, preferably Fe, Co and Ni, more preferably Co and/or Ni, and most preferably Co; and at least one Group VI metal catalytic component, preferably Mo and W, more preferably Mo, on a high surface area support material, such as alumina. Other suitable hydrotreating catalysts include zeolitic catalysts, as well as noble metal catalysts where the noble metal is selected from Pd and Pt. As mentioned above, it is within the scope of the present invention that more than one type of hydrotreating catalyst may be used in the same reaction stage or zone. Typical hydrotreating temperatures range from about 100° C. to about 400° C. with pressures from about 50 psig to about 3,000 psig, preferably from about 50 psig to about 2,500 psig. If one of the reaction stages is a hydrocracking stage, the catalyst can be any suitable conventional hydrocracking catalyst run at typical hydrocracking conditions. Typical hydrocracking catalysts are described in U.S. Pat. No. 4,921,595 to UOP, which is incorporated herein by reference. Such catalysts are typically comprised of a Group VIII metal hydrogenating component on a zeolite cracking base. Hydrocracking conditions include temperatures from about 200° to 425° C.; a pressure of about 200 psig to about 3,000 psig; and liquid hourly space velocity from about 0.5 to 10 V/V/Hr, preferably from about 1 to 5 V/V/Hr. Non-limiting examples of aromatic hydrogenation catalysts include nickel, cobalt-molybdenum, nickel-molybdenum, and nickel-tungsten. Noble metal (e.g., platinum and/or palladium) containing catalysts can also be used. The aromatic saturation zone is preferably operated at a temperature from about 40° C. to about 400° C., more preferably from about 260° C. to about 350° C., at a pressure from about 100 psig to about 3,000 psig, preferably from about 200 psig to about 1,200 psig, and at a liquid hourly space velocity (LHSV) of from about 0.3 V/V/Hr. to about 2 V/V/Hr.

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A hydroprocessing process which includes a vapor reaction stage and two liquid reaction stages comprises the steps of:

(a) reacting a feed comprising a hydrocarbonaceous liquid with hydrogen in a first cocurrent flow liquid reaction stage in the presence of a hydroprocessing catalyst to form a first stage effluent comprising a mixture of a partially hydroprocessed hydrocarbonaceous liquid and a hydrogen-containing hydrocarbonaceous vapor;

(b) separating said liquid and vapor effluent;

(c) reacting said first stage liquid effluent with fresh hydrogen in the presence of a hydroprocessing catalyst in a second cocurrent flow liquid hydroprocessing reaction stage to produce a mixture of hydroprocessed hydrocarbonaceous vapor and product liquid effluents;

(d) separating said liquid and vapor effluents;

(e) reacting said first stage vapor effluent with hydrogen in a vapor hydroprocessing reaction stage to produce an effluent comprising hydroprocessed hydrocarbonaceous vapor, wherein said vapor stage reaction hydrogen is provided by unreacted hydrogen in said first stage vapor effluent;

(f) cooling said second stage and said vapor stage vapor effluents to condense a portion of said hydroprocessed hydrocarbonaceous vapor as additional product liquid and produce uncondensed, hydrogen-rich vapor, and (g) passing said uncondensed hydrogen-rich vapor to said first stage to provide said first stage and said vapor stage reaction hydrogen.

2. A process according to claim 1 wherein said hydrogen-rich vapor is treated to remove contaminants prior to being passed to said first stage.

3. A process according to claim 1 wherein at least a portion of said condensed hydrocarbonaceous vapor is blended with said hydroprocessed product liquid.

4. A process according to claim 1 wherein said combined first and second liquid stage vapor effluents contain hydrogen in an amount sufficient for said first liquid and vapor stage hydroprocessing.

5. A process according to claim 1 wherein a portion of said first stage reaction hydrogen comprises fresh hydrogen.

6. A process according to claim 1 wherein said second liquid and vapor reaction stages are present in a single vessel.

7. A process according to claim 6 wherein said second and vapor reaction stages are separated and wherein control means prevent said first stage vapor effluent from passing into said second liquid stage.

8. A process according to claim 1 wherein said hydrocarbonaceous feed comprises a hydrocarbon liquid.

9. A process according to claim 1 wherein said first stage vapor effluent contains contaminants removed from said feed by said hydroprocessing.

10. A process for hydrotreating a feed comprising a hydrocarbon liquid which contains heteroatom compounds and unsaturates which comprises the steps of:

(a) reacting said feed with hydrogen in a first cocurrent flow reaction stage in the presence of a hydrotreating catalyst to remove most of said heteroatom compounds from said feed and form a first stage effluent comprising a mixture of a mostly hydrotreated liquid and a vapor containing unreacted hydrogen, heteroatom-containing hydrocarbon feed components, light hydrocarbons, $H_2S$ and $NH_3$;

(b) separating said liquid and vapor effluent;

(c) reacting said first stage liquid effluent with fresh hydrogen in the presence of a hydrotrteating catalyst in a second cocurrent flow hydrotreating reaction stage to produce a mixture of hydrotreated hydrocarbon vapor and product liquid effluents;

(d) separating said liquid and vapor effluents;

(e) reacting first stage vapor effluent with hydrogen in the presence of a hydrotreating catalyst in a vapor hydrotreating reaction stage to produce a vapor effluent comprising hydrotreated hydrocarbons, $H_2S$ and $NH_3$, wherein at least a portion of said vapor stage reaction hydrogen is provided by unreacted hydrogen in said first stage vapor effluent;

(f) cooling said second stage and said vapor stage vapor effluents to condense a portion of said hydrotreated hydrocarbon vapor as additional product liquid and produce uncondensed, hydrogen-rich vapor which contains $H_2S$ and $NH_3$;

(g) removing said $H_2S$ and $NH_3$ from said hydrogen-rich vapor to form a clean hydrogen-rich vapor which comprises a hydrogen-containing treat gas, and (h) passing said treat gas to said first stage to provide at least a portion of the reaction hydrogen for said first liquid and vapor stage reactions.

11. A process according to claim 10 wherein said hydrogen-rich vapor is treated to remove said $H_2S$ and $NH_3$ prior to being passed to said first stage.

12. A process according to claim 10 wherein at least a portion of said condensed hydrotreated vapor is blended with said hydrotreated product liquid.

13. A process according to claim 10 wherein said combined first and second liquid stage vapor effluents contain hydrogen in an amount sufficient for said first liquid and vapor stage hydrotreating.

14. A process according to claim 10 wherein a portion of said first stage reaction hydrogen comprises fresh hydrogen.

15. A process according to claim 10 wherein said second liquid and vapor reaction stages are present in a single vessel.

16. A process according to claim 15 wherein said second and vapor reaction stages are separated and wherein control means prevent said first stage vapor effluent from passing into said second liquid stage.

17. A process according to claim 10 wherein said feed comprises a fuel fraction.

18. A process according to claim 10 wherein said first stage vapor effluent contains contaminants removed from said feed by said hydrotreating.

* * * * *